US006092491A

United States Patent [19]

Masters

[11] Patent Number: 6,092,491

[45] Date of Patent: Jul. 25, 2000

[54] BOILER WASH

[76] Inventor: William Masters, 124 Randolph St., Carteret, N.J. 07008

[21] Appl. No.: 09/391,063

[22] Filed: Sep. 16, 1999

Related U.S. Application Data

[60] Provisional application No. 60/101,325, Sep. 22, 1998.

[51] Int. Cl.[7] ..... F22B 37/52

[52] U.S. Cl. ..... 122/390; 122/392; 122/405; 134/168 C

[58] Field of Search ..... 122/379, 390, 122/383, 391, 392, 405; 134/168 C, 169 C, 167 R; 126/315

[56] References Cited

U.S. PATENT DOCUMENTS 2,289,109 7/1942 Edwards et al. .
3,287,005 11/1966 Snelson .
4,666,531 5/1987 Minard .
4,838,211 6/1989 Vago .

*Primary Examiner*—Denise L. Ferensic
*Assistant Examiner*—Gregory A. Wilson
*Attorney, Agent, or Firm*—Patent & Trademark Services; Joseph H. McGlynn

[57] ABSTRACT

A washer for the flueways of a boiler which has an adjustable collar that is inserted between the boiler hood and the exhaust pipe. The collar has an opening through which a spray nozzle is inserted. The spray nozzle is connect to a hot water supply, and has a low voltage solenoid valve which can be connected to a thermostat to turn on and off the supply of hot water as needed.

8 Claims, 2 Drawing Sheets

BOILER WASH

This is a conversion of Provisional S.N. 60/101325, filed Sep. 22, 1998.

BACKGROUND OF THE INVENTION

This invention relates, in general, to a washer for the flueways of a boiler, and, in particular, to a washer for the flueways of a boiler which can be retrofitted to an existing boiler.

DESCRIPTION OF THE PRIOR ART

In the prior art various types of washers have been proposed. For example, U.S. Pat. No. 2,289,109 to Edwards et al discloses a pipe line cleaner with a plug that slides through the pipe and has apertures to introduce a cleaning solution into the pipe.

U.S. Pat. No. 3,287,005 to Snelson discloses jets which are mounted inside an oven to spray molten salt into the oven for cleaning.

U.S. Pat. No. 4,666,531 to Minard discloses a cleaning system for a heater which sprays a cleaning solution into the heater.

U.S. Pat. No. 4,838,211 to Vago discloses a cleaner for a water heater which has a ring of water jets which spray water in a circular pattern to flush out sediment in the bottom of the water heater.

While the prior art patents work for their intended purpose, none of the prior art devices address the problem associated with the build-up of soot in the conventional heating boiler used to heat houses. The soot released as a by-product form the combustion of heating fluids during the heating season can accumulate on the inside of the heating boiler. If not removed, this soot can interfere with the efficient operation of the heater, or even cause a fire. In order to avoid these deleterious effects, the boiler should be cleaned periodically. The present invention is designed to solve this type of soot accumulation and to do it automatically as the boiler is operated.

SUMMARY OF THE INVENTION

The present invention is directed to a washer for the flueways of a boiler which has an adjustable collar that is inserted between the boiler hood and the exhaust pipe. The collar has an opening through which a spray nozzle is inserted. The spray nozzle is connected to a hot water supply, and has a low voltage solenoid valve which can be connected to a thermostat to turn on and off the supply of hot water as needed.

It is an object of the present invention to provide a boiler wash which can be used to wash away accumulations of soot from a boiler.

It is an object of the present invention to provide a boiler wash which can be retrofitted to an existing boiler.

It is an object of the present invention to provide a boiler wash which can be installed easily.

These and other objects and advantages of the present invention will be fully apparent from the following description, when taken in connection with the annexed drawings.

DESCRIPTION OF THE PREFERRED EMBODIMENT

Figure 1:
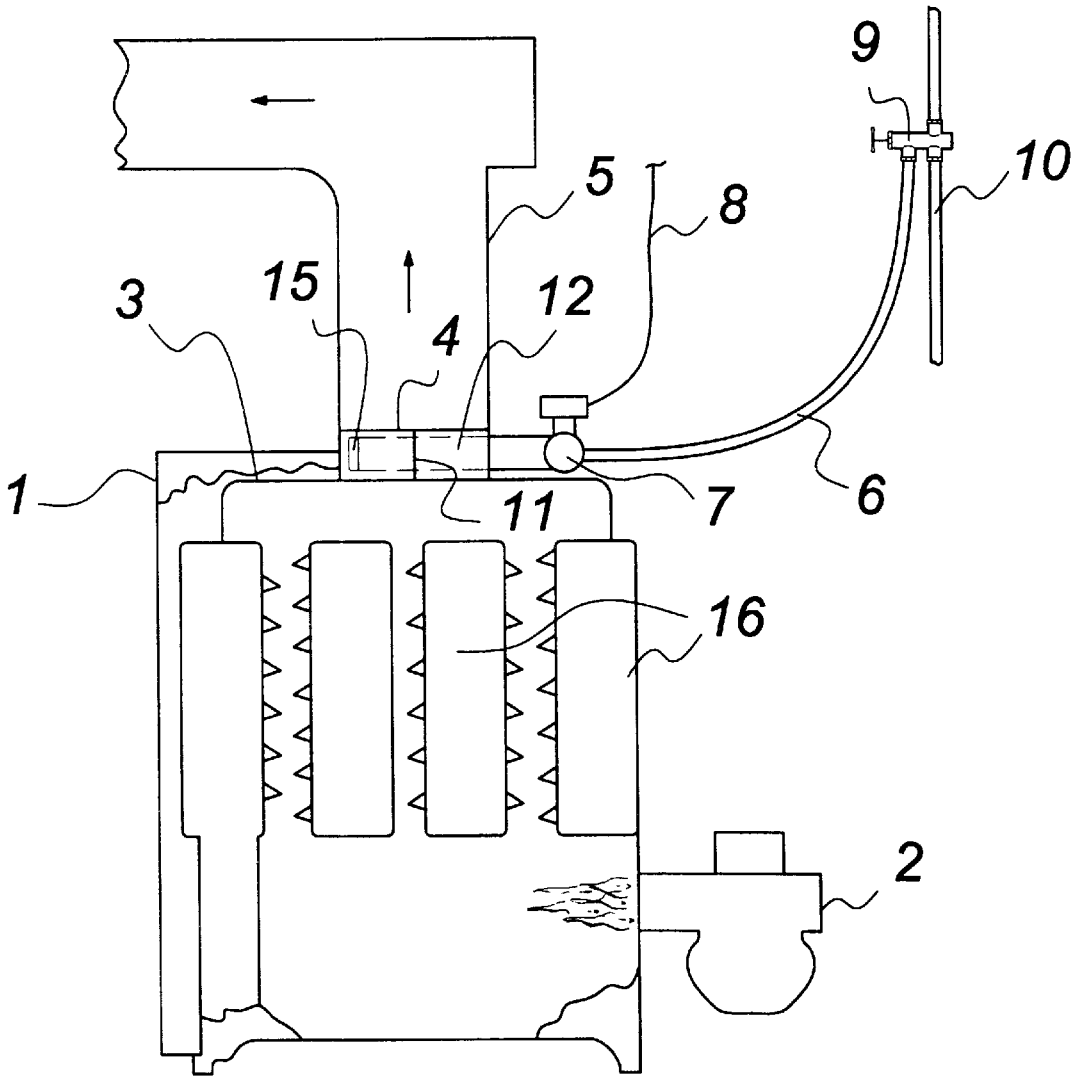
FIG. 1 is a view of the present invention installed on a boiler 1.

Referring now to the drawings in greater detail, FIG. 1 shows the present invention installed on a boiler 1 having an oil burner 2 to distribute heat through a dwelling (not shown) in the conventional manner. It should be noted that the specific type of boiler 1 is not critical and the present invention can be used with any conventional heating system. The boiler 1 has a boiler hood 3 to which is normally attached an exhaust pipe 5 to vent the products of combustion in the boiler to the outside air.

If soot, produced by the combustion of the heating fuel being used, builds up inbetween sections 16 of the boiler 1, it could result in the inefficient operation of the heater or even a fire. The present invention is designed to prevent this.

A collar 4 is installed between the exhaust pipe 5 and the boiler hood 3. The collar 4 can have a split 11, or some other means to make the collar adaptable to different sizes of exhaust pipes 5 and the boiler hoods 3. In addition, screws which extend through apertures 14 can be used to secure the collar to the hood 3.

Figure 2:
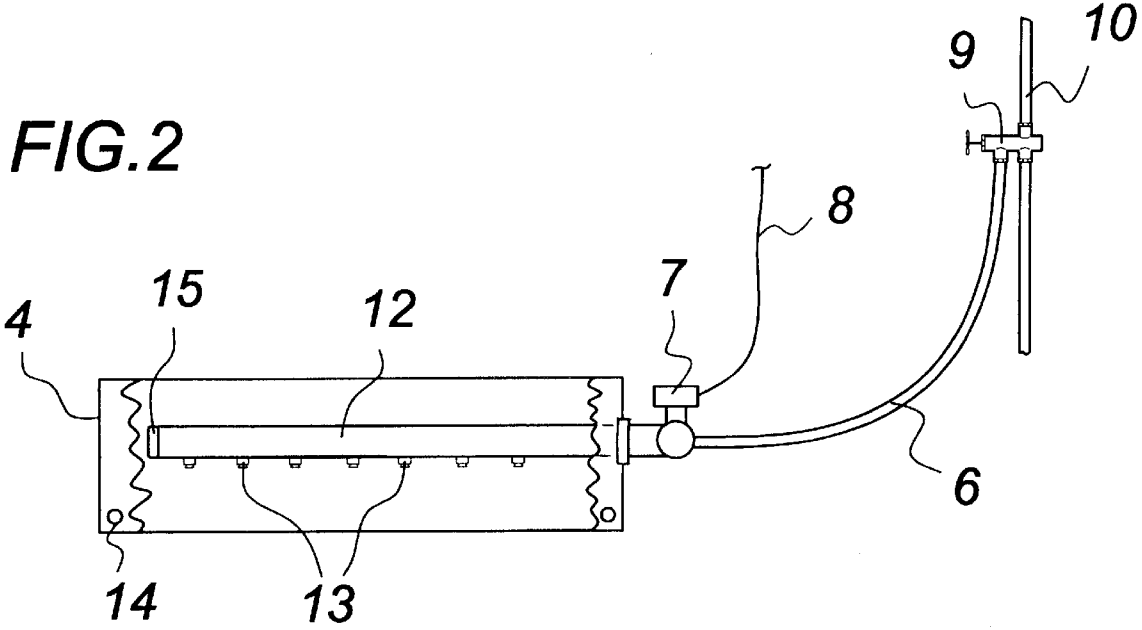
FIG. 2 is a view of the components of the present invention.
Figure 3:
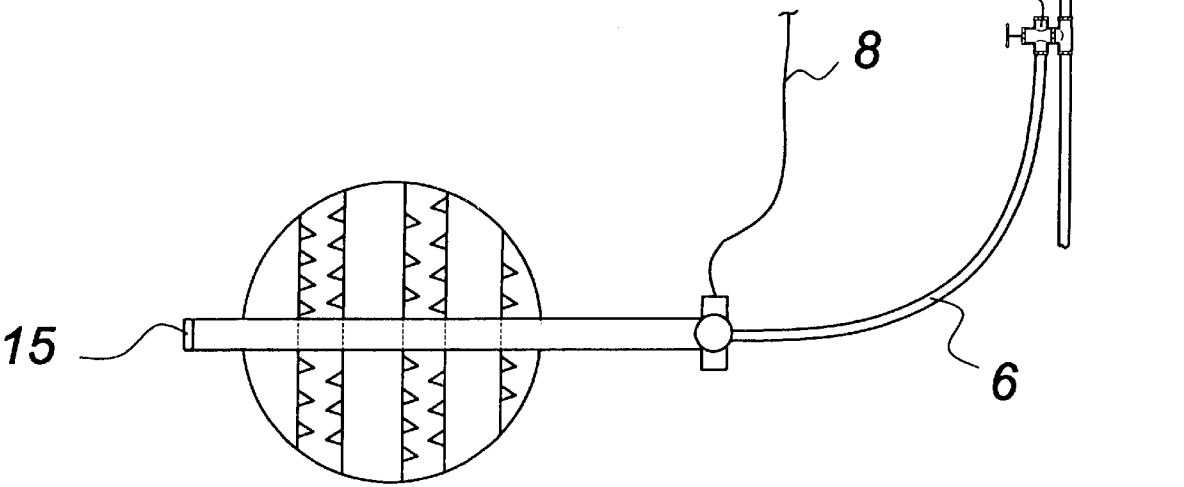
FIG. 3 is an overhead view of components of the present invention showing the relationship of the nozzle to the boiler.

A nozzle 12 is passed through the side of the collar 4, as shown in FIG. 2. The nozzle should be sealed as it passes through the collar in order to prevent water leakage outside the boiler. The nozzle can be sealed using any conventional means which will accomplish the sealing. The nozzle has a cap 15 on one end and a series of jets 13 on the bottom of the nozzle. The number of water jets 13 used will depend on the size of the boiler. Connected to the nozzle 12 is a low voltage solenoid valve 7 which can be electrically connected to a house thermostat (not shown) by wires 8. The solenoid 7 will be wired to the thermostat so that the valve will open when the thermostat calls for the wash cycle. The specific wiring scheme will vary depending on the type of thermostat being used, however, the wiring of the solenoid valve to the thermostat is conventional and, therefore, no further description will be given.

The nozzle 12 is connected to a hot water line 10 by a flexible copper tubing 6 which has a saddle valve 9 attached thereto. Saddle valves are conventional items in the plumbing industry and are well known, so further description of the saddle valve is unnecessary. The connection of the nozzle 12 to the pipe 6 and the connection of the solenoid valve 7 to the pipe 6 can be accomplished by any conventional fixtures commonly used in plumbing. For example, the nozzle 12, which should be made from a high temperature metal to withstand the high temperatures produced by the boiler, can be attached to the pipe 6 by means of ⅛ inch brass compression fittings. The pipe 6 can be ⅛ inch flexible copper tubing, and the saddle valve 9 can be a conventional ⅛ inch saddle valve. However, it should be understood that the type of fitting and the dimensions given are merely for illustration purposes and different dimensions or different types of fittings (i.e. solder fittings) can be used without departing from the scope of the invention.

In use, when the house thermostat calls for the wash cycle, the wiring 8 will turn on the valve 7 which will allow hot water to enter the nozzle 12. The hot water will exit from the apertures 13, which can be oriented to spray water onto all sides of the boiler and, thereby, wash soot from the inside walls of the boiler 1. A minimal amount of water will be needed to perform the washing cycle, and the high temperatures produced by the boiler will evaporate any left over water so there will be no accumulation of water which could damage the boiler.

Although the The Boiler Wash and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A device for washing the interior of a heating boiler, said heating boiler having a boiler, a boiler hood connected to said boiler and an exhaust pipe connected to said boiler hood, said device comprising:

means for connecting a collar between said boiler hood and said exhaust pipe, means on said collar for adjusting said collar to fit different size boiler hoods and exhaust pipes, aperture means in said collar for receiving a water nozzle, means for sealing said aperture means and said water nozzle where said water nozzle passes through said collar, said water nozzle having a plurality of apertures disposed along said water nozzle, said water nozzle being connected to a source of water, valve means for allowing water from said source of water to enter said water nozzle, and to prevent water from said source of water from entering said water nozzle.

2. The device for washing the interior of a heating boiler as claimed in claim 1, wherein said means on said collar for adjusting said collar to fit different size boiler hoods and exhaust pipes is a split in said collar.

3. The device for washing the interior of a heating boiler as claimed in claim 1, wherein said plurality of apertures disposed along said water nozzle are disposed on a side of said water nozzle closest to said boiler.

4. The device for washing the interior of a heating boiler as claimed in claim 1, wherein said device has a second valve means for allowing water from said source of water to enter said water nozzle, and to prevent water from said source of water from entering said water nozzle.

5. The device for washing the interior of a heating boiler as claimed in claim 4, wherein said second valve means is a mechanical valve.

6. The device for washing the interior of a heating boiler as claimed in claim 1, wherein said valve means for allowing water from said source of water to enter said water nozzle, and to prevent water from said source of water from entering said water nozzle is an electrically controlled valve.

7. The device for washing the interior of a heating boiler as claimed in claim 6, wherein said valve means is a solenoid.

8. The device for washing the interior of a heating boiler as claimed in claim 1, wherein said source of water is a hot water source.

* * * * *